US006115577A

United States Patent [19]

Takemoto

[11] Patent Number: 6,115,577

[45] Date of Patent: Sep. 5, 2000

[54] TRANSFER DEVICE

[75] Inventor: Shinichi Takemoto, Toyokawa, Japan

[73] Assignee: Minolta Co., Ltd., Osaka, Japan

[21] Appl. No.: 09/405,312

[22] Filed: Sep. 21, 1999

[30] Foreign Application Priority Data

Sep. 21, 1998 [JP] Japan ..... 10-266547

[51] Int. Cl.[7] ..... G03G 15/16

[52] U.S. Cl. ..... 399/314; 399/66; 399/308

[58] Field of Search ..... 399/296, 297, 399/302, 308, 310, 313, 314, 66

[56] References Cited

U.S. PATENT DOCUMENTS

| | | | |
|---|---|---|---|
| 5,040,028 | 8/1991 | Kamimura et al. | 399/302 |
| 5,053,827 | 10/1991 | Tompkins et al. | 399/302 |
| 5,428,429 | 6/1995 | Fletcher | 399/308 |
| 5,740,508 | 4/1998 | Matsuura et al. | 399/308 |
| 5,873,015 | 2/1999 | Christy | 399/296 |

FOREIGN PATENT DOCUMENTS 8-272227 10/1996 Japan .

*Primary Examiner*—Sophia S. Chen
*Attorney, Agent, or Firm*—Morrison & Foerster, LLP

[57] ABSTRACT

An image forming apparatus of the present invention provided with a movable intermediate transfer belt for primary transfer of a toner image formed on a photosensitive drum, and first and second electrodes disposed in contact with the intermediate transfer belt on the upstream side and the downstream side in the direction of movement of the intermediate transfer belt relative to the region of primary transfer of the toner image for respectively applying voltages to the intermediate transfer belt, wherein the first electrode receives a voltage to control a discharge between the intermediate transfer belt and the photosensitive drum, and the second electrode receives a primary transfer voltage to form a transfer electric field between the intermediate transfer belt and the photosensitive drum.

8 Claims, 9 Drawing Sheets

TRANSFER DEVICE

CROSS-REFERENCE TO RELATED APPLICATIONS

This application is based on Patent Application No. H10-266547 filed in Japan, the content of which is hereby incorporated by reference.

BACKGROUND OF THE INVENTION

1. Field of the Invention

The present invention relates to a transfer device for use in image forming apparatuses of the electrophotographic type such as copiers, printers and the like.

2. Description of the Related Art

Full color copiers and printers of the electrophotographic type have become widely practical in recent years, and there has been increasing demand for improved image quality of various images such as text, graphic, and photographic images. There also has been demand improved image quality on a variety of types of paper in addition to color specialty paper, including thin sheet paper such as stationary stock, and thick sheet paper such as greeting card stock and the like.

In response to these demands, the transfer art for attaining excellent transfer to various kinds of paper and media of toner images in various states of adhesion, i.e., from monochrome toner images to three or four color toner images overlaid and even monochrome toner images include variable density levels ranging from solid to highlight, is an essential art in achieving high quality images and use of general-purpose paper in devices.

Transfer methods of full color image forming apparatuses using the electrophotographic method can be broadly divided into two types of transfer methods of the transfer drum method which sequentially transfers toner images adhered to the surface of a transfer drum to form a color image, and intermediate transfer methods which sequentially transfer toner images to an intermediate transfer body formed as an endless member made of an elastic material having electrical resistance. In recent years the intermediate transfer method has become widely used due to its advantages from the perspectives of using general-purpose paper, and compactness and low cost.

OBJECTS AND SUMMARY

The intermediate transfer method is a transfer method including a process (hereinafter referred to as "primary transfer process") for transferring a toner image formed on a toner image-bearing member is transferred onto an intermediate transfer member is repeated a predetermined number of times to transfer a toner image of each color, and a process (hereinafter referred to as "secondary transfer process") for transferring the resulting multi-colored toner images as a batch onto a paper sheet. Accordingly, in the primary transfer process of a first color, the amount of toner to be transferred from the toner image-bearing member onto the intermediate transfer body is normally one color part, but since in the primary transfer process of a second color, there are instances when the toner image of a second color is transferred and overlaid on the toner image of the first color, and instances when only the toner image of a second color is transferred without the presence of a toner image of a first color, such that if the transfer voltage is set so as to adequately transfer a toner image of a second color overlaid on a toner image of a first color, the transfer voltage is excessive compared to the transfer voltage required to adequately transfer the toner image of only one color.

In the primary transfer process of a third color, there are instances when the toner image of a third color is transferred and overlaid on the toner images of a first color and a second color, and instances when only the toner image of a third color is transferred without the presence of a toner image of a first color and a second color, such that if the transfer voltage is set to adequately transfer a toner image of a third color onto the toner image of a second color, the transfer voltage is excessive compared to the transfer voltage required to adequately transfer the toner image of only one color.

When the transfer voltage is excessive, a discharge phenomenon occurs in the area directly anterior to the transfer nip at which the intermediate transfer body contacts the toner image-bearing member due to the difference of electric potential between the surface of the intermediate transfer body and the toner image on the toner image-bearing member, such that this discharge reverses the polarity of the toner on the toner image-bearing member, so as to disadvantageously prevent adequate primary transfer particularly when forming a monochrome toner image on an intermediate transfer body, thereby reducing image quality.

Just as in the primary transfer process, when the transfer voltage also is excessive in the secondary transfer process, a discharge phenomenon occurs in the area directly anterior to the transfer nip due to the difference of electric potential between the paper and the toner image on the toner image-bearing member, such that this discharge reverses the polarity of the toner on the toner image-bearing member, so as to disadvantageously prevent adequate secondary transfer particularly of a monochrome toner image, thereby reducing image quality.

An object of the present invention is to provide an image forming apparatus having excellent transfer characteristics relative to changes of toner adhesion states including monochrome toner images, two-color toner images, and three-color toner images.

These objects are attained by the image forming apparatus of the present invention provided with a movable intermediate transfer body for primary transfer of a developer image formed on an image-bearing member, and first and second electrodes disposed in contact with the intermediate transfer body on the upstream side and the downstream side in the direction of movement of the intermediate transfer body relative to the region of primary transfer of the developer image for respectively applying voltages to the intermediate transfer body, wherein the first electrode on the upstream side receives a voltage to control a discharge between the intermediate transfer body and the image-bearing member, and the second electrode on the downstream side receives a primary transfer voltage to form a transfer electric field between the intermediate transfer body and the image-bearing member.

Another image forming apparatus of the present invention is provided with a movable intermediate transfer body for primary transfer of a developer image formed on an image-bearing member, a transfer-receiving member for secondary transfer of a developer image transferred to the intermediate transfer body, and first and second electrodes disposed in contact with the intermediate transfer body on the upstream side and the downstream side in the direction of movement of the intermediate transfer body relative to the region of secondary transfer of the developer image for respectively applying voltages to the intermediate transfer body, and an opposed electrode opposing the second electrode through the intermediate transfer body and the transfer-receiving member, wherein the first electrode on the upstream side receives a voltage to control a discharge between the intermediate transfer body and the image-bearing member, and the opposed electrode receives a secondary transfer voltage to form a transfer electric field between the image-bearing member and the intermediate transfer body to which a voltage is applied by the second electrode.

Another image forming apparatus of the present invention is provided with a rotatable image-bearing member for forming a developer image on the surface thereof, a transfer member disposed in contact with the image-bearing member to form a transfer nip, a transfer-receiving member for receiving a transferred developer image on the image-bearing member via a transfer electric field generated between the transfer-receiving member and the image-bearing member when the transfer-receiving member passes through the transfer nip, and first and second electrodes disposed in contact with the transfer member on the upstream side and the downstream side in the direction of rotation of the image-bearing member relative to the transfer nip for respectively applying voltages to the transfer member, wherein the first electrode on the upstream side receives a voltage to control a discharge between the transfer member and the image-bearing member, and the second electrode on the downstream side receives a voltage to form a transfer electric field.

In the primary transfer process of the image forming apparatus of the present invention, since the first electrode receives a voltage to control a discharge between the image-bearing member and the transfer member, excellent transfer to the intermediate transfer body of a monochrome developer image is obtained even when the second electrode receives a voltage to form a transfer electric field capable of sufficiently transferring a developer image of another color overlaid on a single color image or multiple color images on the intermediate transfer body.

That is, a primary transfer of a developer image of another color onto the developer image of one color or a plurality of colors, as well as a primary transfer of only a monochrome developer image are both excellently accomplished by an identical primary transfer voltage applied to the second electrode.

In another image forming apparatus of the present invention, since the first electrode receives a voltage to control a discharge between the intermediate transfer body and the transfer-receiving member, excellent transfer of a monochrome developer image is accomplished even when the opposed electrode receives a secondary transfer voltage for forming a transfer electric field capable of batch transfer of a plurality of color images overlaid on the intermediate transfer body to the transfer-receiving member, and excellent transfer of a developer image to a thin-sheet transfer-receiving member is accomplished even when the opposed electrode receives a secondary transfer voltage sufficient to form a transfer electric field capable of transferring a developer image onto a thick-sheet transfer-receiving member. That is, both excellent secondary transfer of a plurality of color developer images and secondary transfer of a monochrome developer image can be accomplished by an identical secondary transfer voltage applied to the opposed electrode, so as to obtain excellent secondary transfer of a developer image to various transfer-receiving members including thin sheets and thick sheets.

In another image forming apparatus of the present invention, since the first electrode receives a voltage to control a discharge between the image-bearing member and the transfer-receiving member, excellent transfer of a developer image is accomplished for thin-sheet transfer-receiving members even when the second electrode receives a voltage for forming a transfer electric field sufficient for transferring a developer image to a thick-sheet transfer-receiving member. That is, excellent secondary transfer of a developer image to various transfer-receiving members including thin sheets and thick sheets is obtained by an identical voltage applied to the second electrode.

BRIEF DESCRIPTION OF THE DRAWINGS

These and other objects and features of the present invention will become apparent from the following description of the preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

Figure 1:
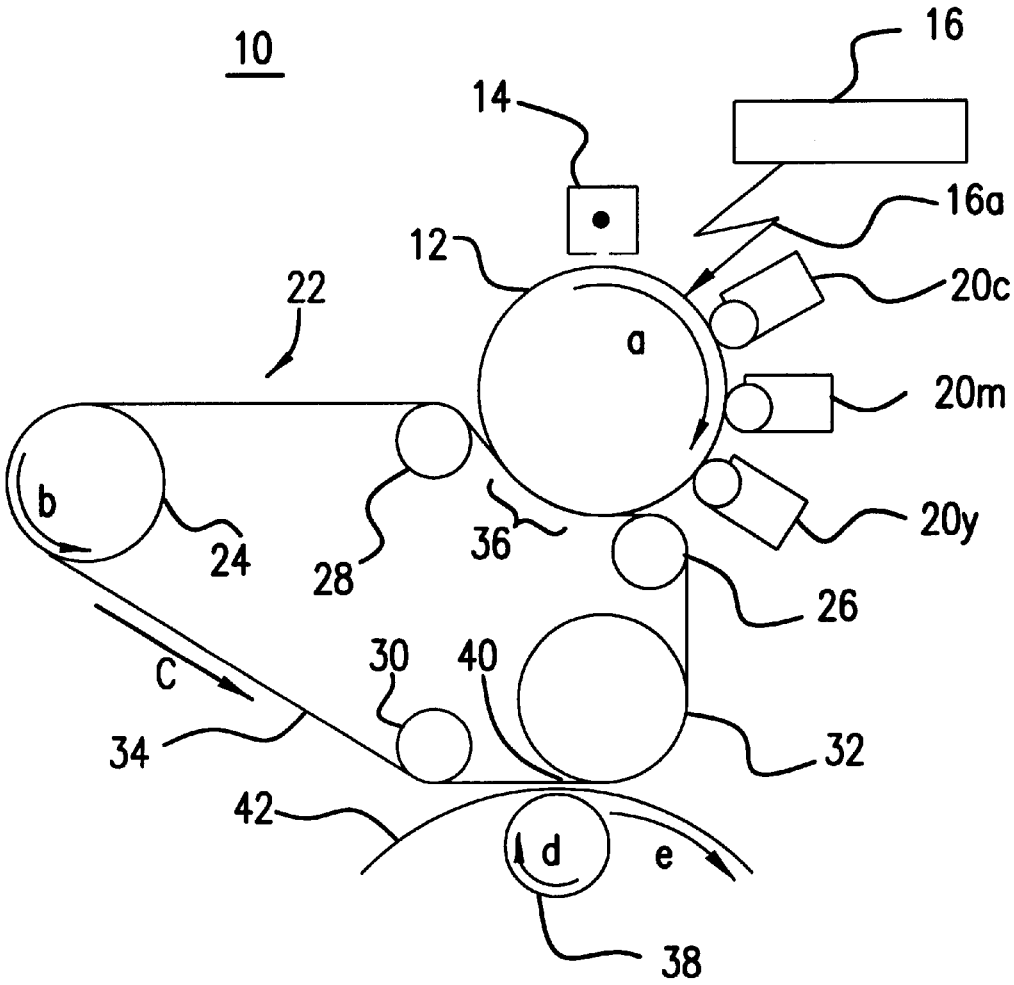
FIG. 1 briefly shows the construction of an image forming apparatus of a first embodiment.

The preferred embodiments of the present invention are described hereinafter with reference to the accompanying drawings. FIG. 1 briefly shows the main parts of an image forming apparatus 10 of a first embodiment. The image forming apparatus 10 is provided with a photosensitive drum (image-bearing member) 12 which rotates in the arrow a direction. Arranged sequentially in the direction of rotation around the photosensitive drum 12 are a charger 14, an exposure device 16, three developing devices 20*c*, 20*m*, 20*y*, and a transfer device 22. The developing device 20*c* accommodates negatively charged cyan toner (developer). The developing device 20*m* accommodates negatively charged magenta toner (developer). The developing device 20*y* accommodates negatively charged yellow toner (developer).

The transfer device 22 comprises a drive roller 24 drivably rotated in the arrow b direction, and an endless-type intermediate transfer belt (intermediate transfer body) 34 reeved around and in contact with four rod-shaped electrodes 26, 28, 30, 32 formed of stainless steel or aluminum.

The intermediate transfer belt 34 is formed of a resin sheet such as polycarbonate or the like, and has a dispersion of carbon black to achieve a surface electrical resistance of approximately $10^5$~$10^{12}$ ($\Omega/cm^2$). The intermediate transfer belt 34 is driven by the drive roller 24 so as to rotate in the arrow c direction. Although the four rod-shaped electrodes 26, 28, 30, 32 are not drivably rotated by the movement of the intermediate transfer belt 34, they may be so driven in rotation.

The area of the intermediate transfer belt 34 between the two rod-like electrodes 26 and 28 contact the photosensitive drum 12 and forms the primary transfer region 36. In the following description relating to the primary transfer region 36, the rod-like electrode 26 on the upstream side in the direction of rotation of the intermediate transfer belt 34 is designated the first electrode 26, and the rod-like electrode 28 on the downstream side in the direction of rotation is designated the second electrode 28.

Below the rod-like electrode 32 is disposed a transfer roller 38 which is driven in rotation in the arrow d direction. The transfer roller 38 functions a an opposed electrode opposing the rod-like electrode 32 through the intermediate transfer belt 34 and the transfer-receiving member 42. The transfer roller 38 is formed, for example, of foam rubber material such as silicon, urethane, or the like, and has a dispersion of carbon black to attain a surface electrical resistance of approximately $10^5$~$10^{12}$ ($\Omega/cm^2$). The region of the intermediate transfer belt 34 between the transfer roller 38 and the rod-like electrode 32 is designated the secondary transfer region 40. A transfer-receiving member 42 such as a paper sheet or the like is transported in the arrow e direction between the transfer roller 38 and the rotating intermediate transfer belt 34. In the following description relating to the secondary transfer region 40, the rod-like electrode 30 on the upstream side in the direction of rotation of the intermediate transfer belt 34 is designated the first electrode 30, and the rod-like electrode 32 on the downstream side in the direction of rotation is designated the second electrode 32.

In the image forming apparatus 10, the surface of the photosensitive drum 12 is uniformly charged by the charger 14. The uniformly charged surface of the photosensitive drum 12 is irradiated by a laser beam 16*a* corresponding to the image information emitted from the exposure device 16. In this way the electric potential of the laser exposed area is reduced so as to form an electrostatic latent image on the surface of the photosensitive drum 12. When this electrostatic latent image arrives opposite the developing device 20*c* in conjunction with the rotation of the photosensitive drum 12, cyan toner accommodated in the developing device 20*c* adheres to the electrostatic latent image so as to develop the image and form a cyan toner image on the surface of the photosensitive drum 12. This cyan toner image moves to the primary transfer region 36 in conjunction with the rotation of the photosensitive drum 12, and is transferred to the intermediate transfer belt 34 in a primary transfer. Then, a magenta toner image is similarly formed on the surface of the photosensitive drum 12 by the developing device 20*m*, and in the primary transfer region 36 the magenta toner image is transferred in a primary transfer so as to be overlaid on the cyan toner image on the intermediate transfer belt 34. Then, a yellow toner image is similarly formed on the surface of the photosensitive drum 12 by the developing device 20*y*, and in the primary transfer region 36 the yellow toner image is transferred in a primary transfer so as to be overlaid on the magenta toner image and cyan toner image on the intermediate transfer belt 34. In this way a color toner image is formed on the intermediate transfer belt 34.

When the color toner image formed on the intermediate transfer belt 34 arrives at the secondary transfer region 40 in conjunction with the rotation of the intermediate transfer belt 34, the color toner image is transferred in a secondary transfer onto a transfer-receiving member 42 transported to the secondary transfer region 40 synchronously with the movement of the color toner image. The color toner image transferred onto the transfer-receiving member 42 is permanently fixed thereon as the transfer-receiving member 42 passes through a fixing device not shown in the drawings.

Figure 2:
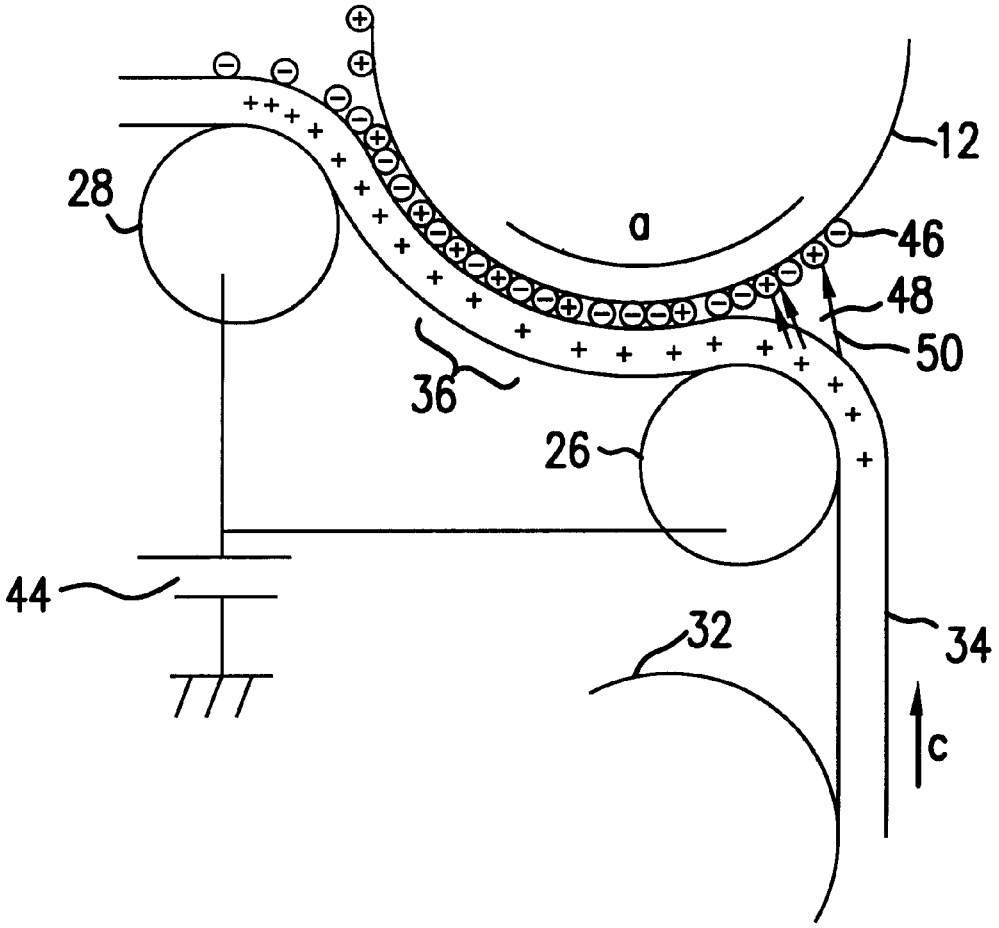
FIG.2 PRIOR ART
FIG. 2 shows an enlarged view of the vicinity of the primary transfer region in an image forming apparatus of the conventional art.
Figure 4:
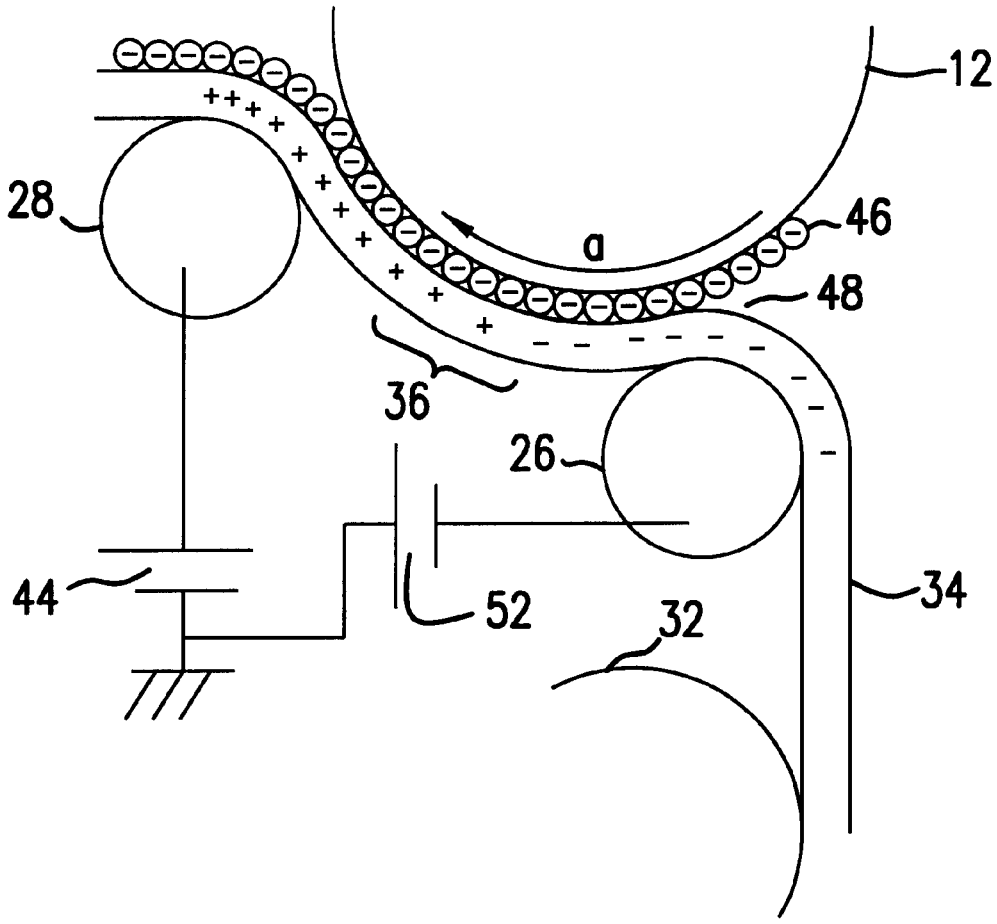
FIG. 4 shows an enlarged view of the vicinity of the primary transfer region in an image forming apparatus of the present embodiment.

The primary transfer process is described below. FIGS. 2 and 4 are enlarged views of the vicinity of the secondary transfer region 36. In the conventional art, a power source 44 applies a voltage to the first electrode 26 and the second electrode 28 of a polarity which is the opposite of the polarity of the toner 46, i.e., a positive voltage is applied, such that by means of this voltage a positive potential is generated of a polarity opposite the polarity of the toner on the surface of the intermediate transfer belt 34, and this positive potential electrostatically attracts the negatively charged toner 46 on the surface of the photosensitive drum 12 to adhere to the surface of the intermediate transfer belt 34 to accomplish the primary transfer.

In this case, however, since the voltage of opposite polarity to the toner 46 is applied to both the first electrode 26 and the second electrode 28, when the voltage becomes excessive, a discharge phenomenon 50 is generated in the area 48 directly anterior to the primary transfer region 36 due to the difference in potential between the surface of the intermediate transfer belt 34 and the surface potential of the toner image on the surface of the photosensitive drum 12, such that the polarity within the toner 46 on the photosensitive drum 12 is reversed to positive by this discharge. In this way the reversed polarity toner 46 is not transferred to the intermediate transfer belt 34 and remains adhered to the surface of the photosensitive drum 12 and passes through the primary transfer region 38, such that a excellent transfer is not achieved.

Figure 3:
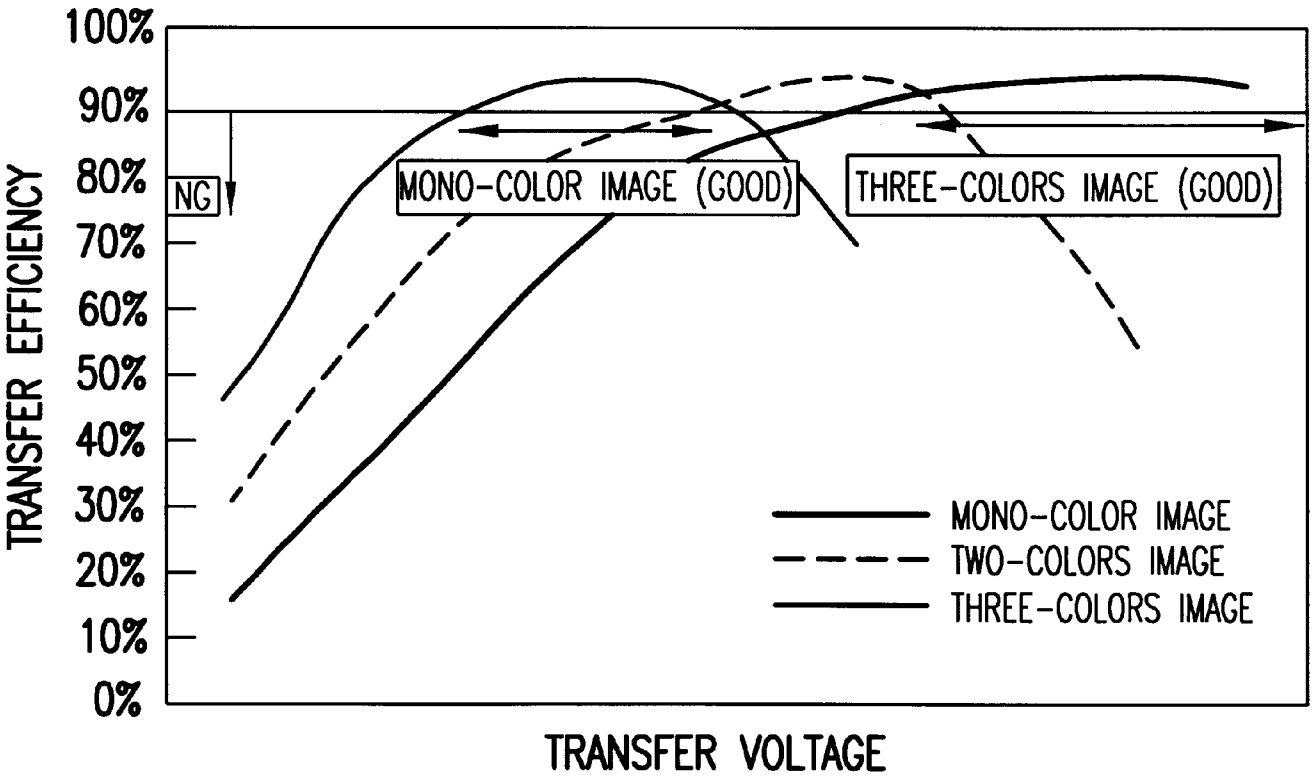
FIG.3 PRIOR ART
FIG. 3 is a graph showing the relationship between the transfer voltage and the transfer efficiency in the conventional art.

This problem is described in detail with reference to FIG. 3. In the primary transfer process for a third color yellow toner image, there are instances when a third color yellow toner image is transferred onto a two-color toner image of cyan and magenta in the intermediate transfer belt 34 (referred to as "three-color primary transfer"), and instances when only a yellow toner image is transferred onto the intermediate transfer belt 34 which does not bear another toner image (referred to as "mono-color primary transfer"). The optimum value of the transfer voltage differs for three-color primary transfer and mono-color primary transfer, and the optimum transfer voltage value is higher for three-color primary transfer. The dual ended arrows (←→) in FIG. 3 represent the allowable range of the transfer voltages for three-color primary transfer and mono-color primary transfer to achieve excellent transfer when the transfer efficiency (amount of toner on the intermediate transfer belt 34 after transfer divided by the amount of toner on the photosensitive drum 12 before transfer) exceeds approximately 90%. Since the allowable range of the respective transfer voltages do not overlap at all, the transfer voltage becomes excessive when achieving excellent three-color primary transfer, and excellent mono-color primary transfer cannot be obtained due to the discharge phenomenon 50 in the area 48 directly anterior to the primary transfer region 36. That is, the transfer voltage for obtaining excellent three-color primary transfer is excessive for a mono-color primary transfer, such that it is necessary to control the discharge phenomenon 50 in the area 48 directly anterior to the primary transfer region 36 in order to achieve excellent mono-color primary transfer and three-color primary transfer using the same transfer voltage.

In the image forming apparatus 10 of the present embodiment, a power source 52 is provided, to apply to the first electrode 26 a voltage to control the discharge phenomenon between the intermediate transfer belt 34 and the photosensitive drum 12 in the area 48 directly anterior to the primary transfer region 36, as shown in FIG. 4. More specifically, a negative voltage of the same polarity as the toner 46 is applied to the first electrode 26. In this way a surface potential of the same polarity as the toner 46 is generated on the intermediate transfer belt 34 in the area 48 directly anterior to the primary transfer region 36, thereby minimizing the difference in potential with the surface potential of the toner image 46 on the photosensitive drum 12 so as to suppress the discharge phenomenon. Although a voltage of the same polarity as the toner 46 is applied to the first electrode 26 in the present embodiment, the voltage applied to the first electrode 26 may have an opposite polarity to the polarity of the toner 46 if the voltage is capable of suppressing the discharge phenomenon in the area 48 directly anterior to the primary transfer region 36.

Relative to the voltage applied to the second electrode 28, the voltage applied to the first electrode 26 may have a voltage value located at a position deflected to the same polarity side as the polarity of the toner 46.

On the other hand, when a voltage having the opposite polarity of the toner 46 is applied to the second electrode 28 by the power source 44, a positive surface potential of the opposite polarity to the toner 46 is generated on the intermediate transfer belt 34 in the primary transfer region 36 by the second electrode 28. In this way a transfer electric field is formed between the photosensitive drum 12 and the intermediate transfer belt 34, so as to obtain excellent primary transfer of a toner image 46 on the photosensitive drum 12 to the intermediate transfer belt 34 by means of the electrostatic action of this electric field.

Figure 5:
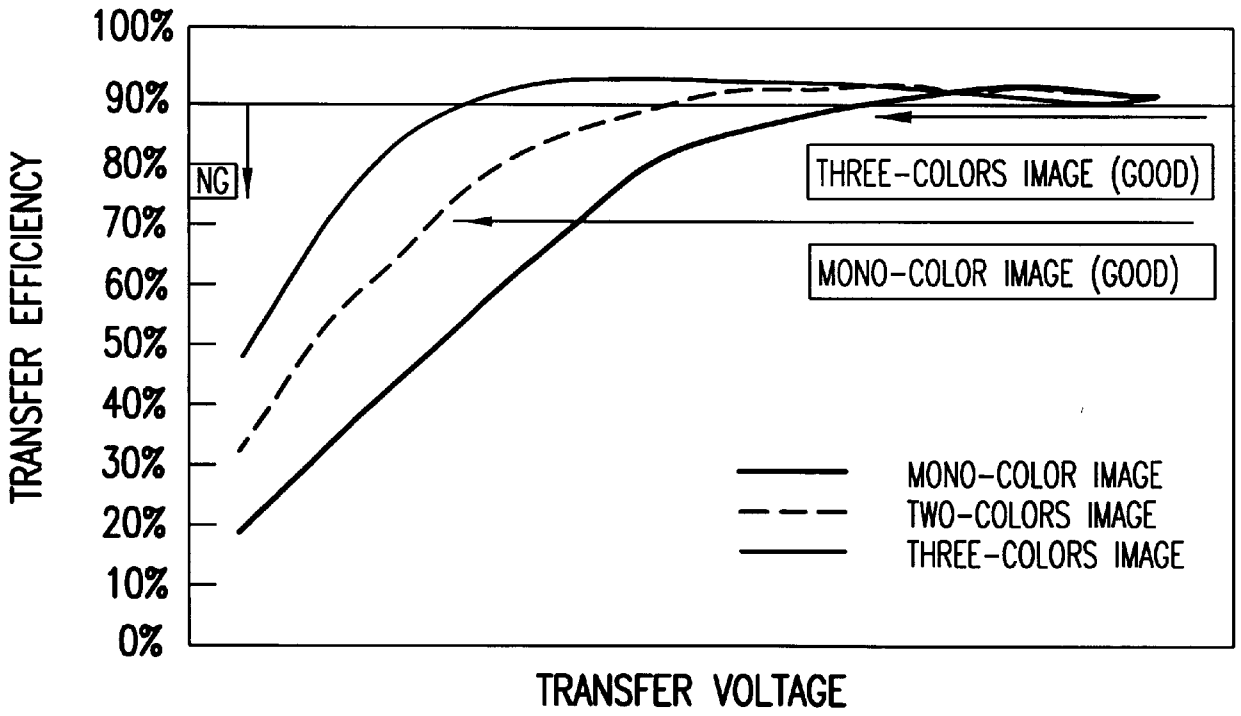
FIG. 5 is a graph showing the relationship between the transfer voltage and the transfer efficiency in the present embodiment.

The effectiveness of the image forming apparatus 10 of the present embodiment is described below with reference to FIG. 5. In FIG. 5, the arrow (←) represents the allowable range of the transfer voltage applied to the second electrode 28 for three-color primary transfer and mono-color primary transfer to achieve excellent transfer at a transfer efficiency exceeding approximately 90%. At this time, a voltage of −100 V is applied to the first electrode 26. Although the allowable range of a transfer voltage achieving excellent three-color primary transfer is virtually the same to that of the conventional art shown in FIG. 3, excellent transfer can be obtained across a high voltage without generating a discharge phenomenon in the area 48 directly anterior to the primary transfer region 38 even when a larger than conventional transfer voltage is applied in a mono-color primary transfer, such that it is possible to simultaneously obtain excellent three-color primary transfer and mono-color primary transfer.

In the image forming apparatus 10 of the present embodiment, since a voltage to control the discharge between the intermediate transfer belt 34 and the photosensitive drum 12 is applied to the first electrode 26 in the primary transfer process, excellent transfer of a monochrome toner image to an intermediate transfer belt 34 which does not bear any toner image is obtained even when the second electrode 28 receives a voltage for forming an electric field sufficient to transfer a mono-color or multicolor toner image to the intermediate transfer belt 34. That is, the primary transfer of a toner image of another color onto a mono-color toner image or a plurality of colors of toner images, and the primary transfer of only a monochrome toner image are both excellent.

Figure 6:
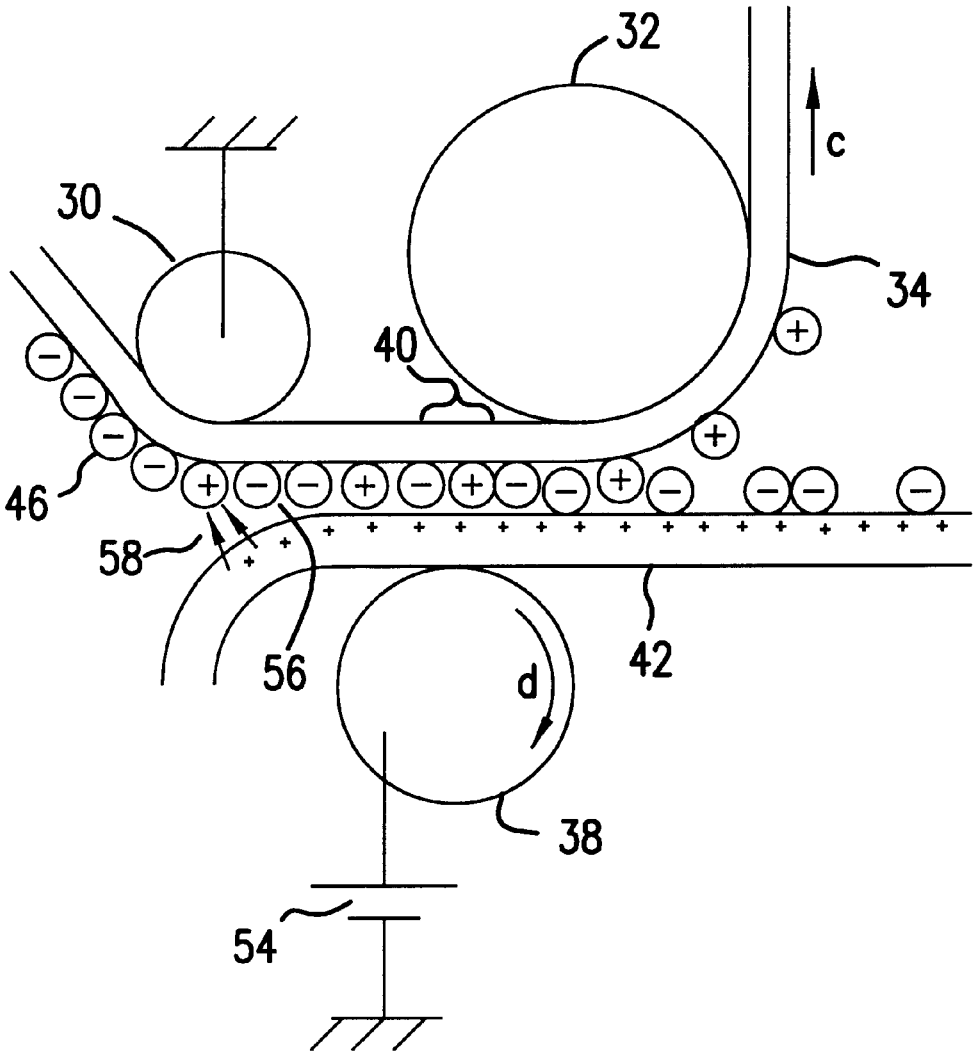
FIG.6 PRIOR ART
FIG. 6 shows an enlarged view of the vicinity of the secondary transfer region in an image forming apparatus of the conventional art.
Figure 7:
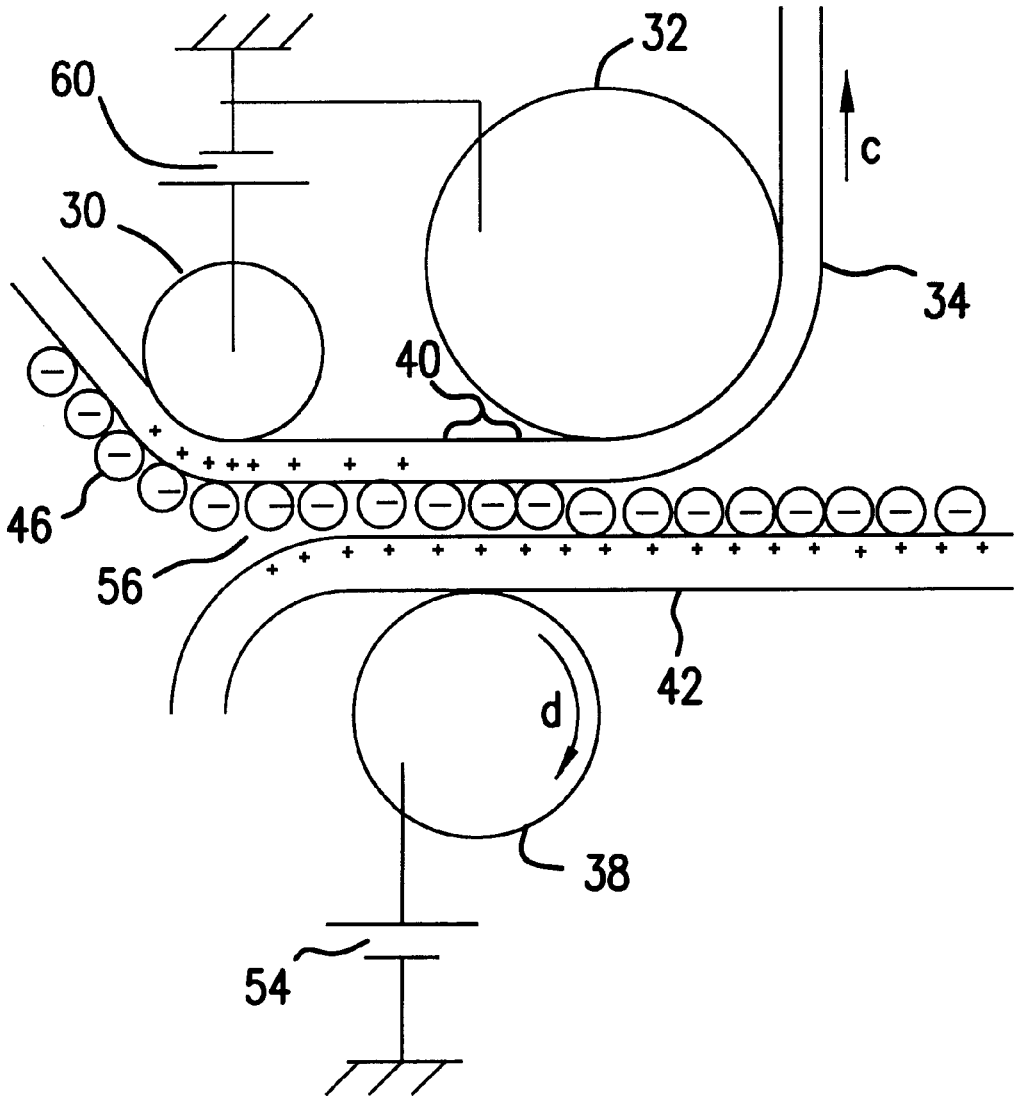
FIG. 7 shows an enlarged view of the vicinity of the secondary transfer region in an image forming apparatus of the present embodiment.

The secondary transfer process is described below. FIGS. 6 and 7 show enlarged views of the vicinity of the secondary transfer region 40.

As shown in FIG. 6, in the conventional art the first electrode 30 is grounded, and the transfer roller 38 becomes an opposed electrode when a positive secondary voltage is applied thereto by the power source 54. On the other hand, the second electrode 32 floats and does not directly participate electrically in the secondary transfer. In this case, since the first electrode 30 is grounded, the surface potential of the intermediate transfer belt 34 is at a low level near grounded in the area 56 directly anterior to the secondary transfer region 56, such that when the transfer voltage applied to the transfer roller 38 becomes excessive and the surface potential of the charged transfer-receiving member 42 increases, a discharge phenomenon 58 is generated by the difference in potential of the surface potential of the toner image 46 on the intermediate transfer belt 34, and this discharge reverses the polarity to positive in the toner 46 on the intermediate transfer belt 34. In this way the reversed polarity toner 46 is not transferred to the transfer-receiving member 42 and remains adhered to the surface of the intermediate transfer belt 34 and passes through the secondary transfer region 40, such that a excellent transfer is not achieved.

In the secondary transfer process, consideration must be given not only to the transfer of a three-color toner image to the transfer-receiving member 42 (referred to as "three-color secondary transfer") and the transfer of only a mono-color toner image to the transfer-receiving member 42 (referred to as "mono-color secondary transfer"), but also the use of various types of thick sheets and thin sheets as the transfer-receiving member 42. In general, the optimum value of the secondary transfer voltage is higher when accomplishing three-color secondary transfer than when accomplishing mono-color secondary transfer, and the optimum secondary transfer voltage is higher for thick sheets than for thin sheets. Therefore, the same problem occurs in the secondary transfer process as has been described in the primary transfer process with reference to FIG. 3, wherein a transfer voltage sufficient to achieve excellent mono-color secondary transfer is insufficient to achieve excellent three-color secondary transfer, and a transfer voltage sufficient to achieve excellent three-color secondary transfer becomes excessive such that excellent mono-color secondary transfer cannot be achieved due to the discharge phenomenon 58 in the area 56 directly anterior to the secondary transfer region 40. In addition, a transfer voltage sufficient to achieve excellent mono-color secondary transfer to a thin sheet is insufficient to achieve excellent three-color secondary transfer to a thick sheet, and a transfer voltage sufficient to achieve excellent three-color secondary transfer to a thick sheet becomes excessive so as to prevent excellent mono-color secondary transfer due to the discharge phenomenon. That is, since the transfer voltage must be excessive for mono-color secondary transfer to achieve excellent three-color secondary transfer, and the transfer voltage must be excessive for thin sheets to achieve excellent secondary transfer for thick sheets, the discharge phenomenon in area 56 directly anterior to the secondary transfer region 40 must be suppressed to achieve excellent transfer for both mono-color secondary transfer and three-color secondary transfer at the same transfer voltage as well as achieving excellent transfer for both thin sheets and thick sheets.

In the image forming apparatus 10 of the present embodiment, a voltage is applied to the first electrode 30 to control the discharge between the intermediate transfer belt 34 and the photosensitive drum 12 in the area 56 directly anterior to the secondary transfer region 40, and a secondary transfer voltage for forming a transfer electric field between the intermediate transfer belt 34 and the transfer-receiving member 42 is applied to the transfer roller 38 which functions as the opposed electrode of the second electrode 32.

More specifically, a positive voltage of opposite polarity to the toner 46 is supplied beforehand by the power source 60 to the first electrode 30, so as to generate a surface potential of the same polarity as the transfer-receiving member 42 on the intermediate transfer belt 34 at the area 56 directly anterior to the secondary transfer region 40 by means of this voltage. In this way the difference is minimized between the surface potential of the transfer-receiving member 42 and the surface potential of the toner image 46 on the intermediate transfer belt 34, thereby suppressing the discharge phenomenon. Although a voltage of opposite polarity to the toner 46 is applied to the first electrode 30, a voltage of the same polarity as the toner 46 or a grounded voltage may be applied to the first electrode 30 insofar as the voltage is capable of controlling the discharge phenomenon in the area 56 directly anterior to the secondary transfer region 40.

The second electrode 32 is grounded, and the opposed electrode is the transfer roller 38 to which a secondary transfer voltage is applied. In this way a transfer electric field is formed between the transfer-receiving member 42 which has a positive surface potential and the intermediate transfer belt 34 which has a surface potential at the grounded level, such that the toner image 46 on the intermediate transfer belt 34 is transferred in the secondary transfer region 40 by means of the electrostatic action of this electric field. The voltage applied to the second electrode 32 is not limited to a grounded voltage, and may be, for example, a negative voltage of the same polarity as the toner 46 insofar as the voltage is capable of forming a transfer electric field between the intermediate transfer belt 34 and the transfer-receiving member 42.

In the image forming apparatus 10 of the present embodiment, since a voltage to control the discharge between the intermediate transfer belt 34 and the transfer-receiving member 42 is applied to the first electrode 30, excellent transfer of monochrome toner images is achieved even when a secondary transfer voltage is applied to the transfer roller 38 sufficient to form a transfer electric filed capable of batch transfer of a plurality of color toner images overlaid on the intermediate transfer belt 34 to the transfer-receiving member 42, and excellent transfer of toner images to a thin-sheet transfer-receiving member 42 is obtained even when the secondary voltage applied to the transfer roller 38 is sufficient to form a transfer electric field capable of transferring a toner image to a thick-sheet transfer-receiving member 42. That is, excellent secondary transfer of both a monochrome toner image and secondary transfer of a plurality of color images is obtained by the same secondary transfer voltage applied to the transfer roller 38, and excellent secondary transfer is obtained for a toner image to various types of transfer-receiving members 42 such as thick sheets, thin sheets and the like.

A mono-color image forming apparatus of a second embodiment is described below with reference to FIGS. 8 and 9. Structural components common to the previously described image forming apparatus 10 are designated by like reference numbers and are not described in detail.

Figure 8:
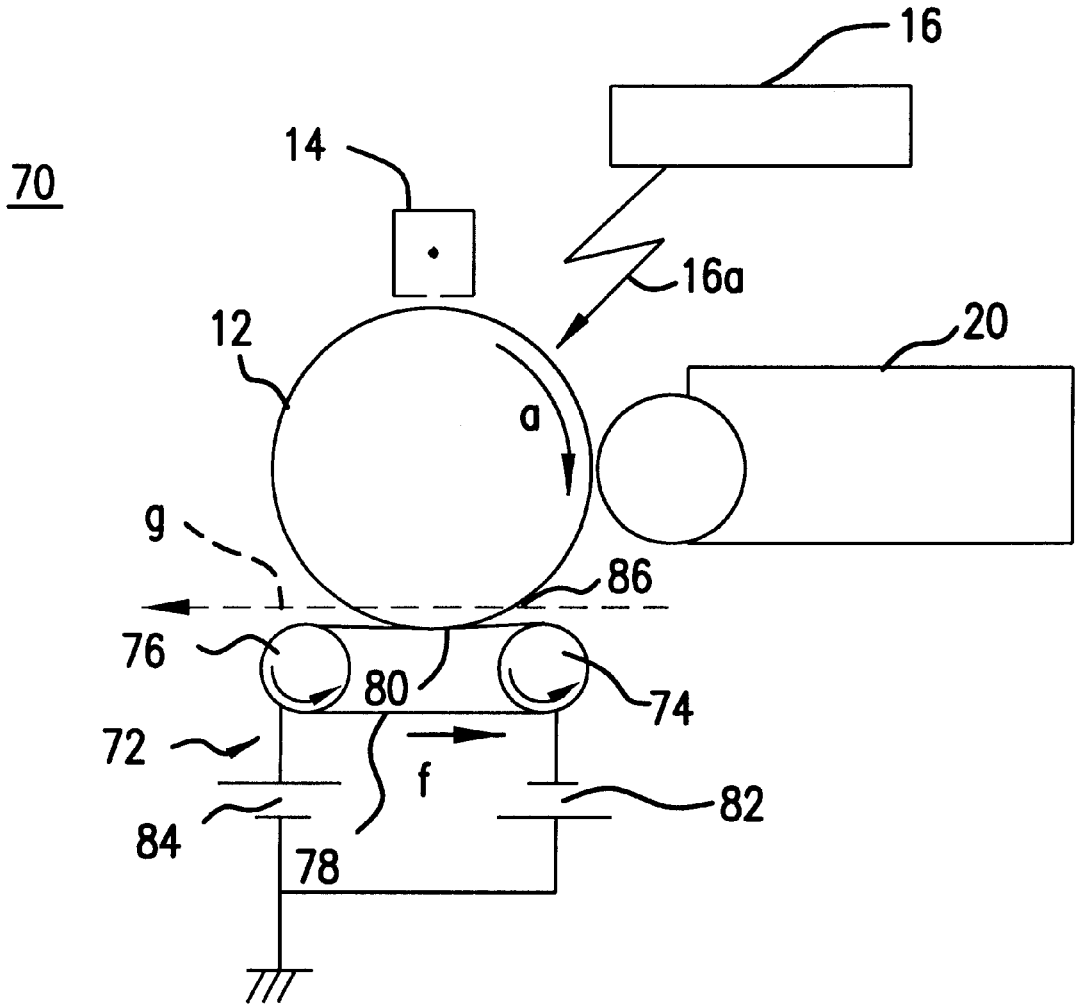
FIG. 8 briefly shows the construction of an image forming apparatus of a second embodiment.

The image forming apparatus 70 shown in FIG. 8 is provided with a photosensitive drum 12, a charger 14, an exposure device 16, a developing device 20, and a transfer device 72. A toner image is formed by well known electrophotographic process on the surface of the photosensitive drum 12 via the charger 14, the exposure device 16, and the developing device 20.

The transfer device 72 comprises metal rod-like first and second electrodes 74 and 76 formed of stainless steel, aluminum or the like, and an endless belt-type transfer member 78 reeved around and in contact with the first and second electrodes 74 and 76. The transfer member 78 is driven in rotation by at least one of the electrodes 74 and 76 so as to move in the arrow f direction, and contacts the photosensitive drum 12 so as to form a transfer nip 80. The first electrode 74 is disposed on the upstream side in the direction of rotation of the photosensitive drum 12 relative to the transfer nip 80, and the second electrode 76 is disposed on the downstream side in the direction of rotation of the photosensitive drum 12 relative to the transfer nip 80. A transfer-receiving member such as a paper sheet or the like not shown in the drawing is transported in the arrow g direction so as to pass through the transfer nip 80 via the rotation of the photosensitive drum 12 and the transfer member 78.

The transfer member 78 is formed of a resin sheet such as polycarbonate or the like, and has a dispersion of carbon black to achieve a surface electrical resistance of approximately $10^5$~$10^{12}$ ($\Omega/cm^2$) similar to the previously described intermediate transfer belt 34. A negative voltage of the same polarity as the toner on the photosensitive drum 12 is applied to the first electrode 74 by a power source 82. A positive voltage of opposite polarity to the toner on the photosensitive drum 12 is applied to the second electrode 76 by a power source 84.

In the image forming apparatus 70 of the aforesaid construction, a transfer-receiving member is transported to the transfer nip 80 synchronously with the arrival of the toner image on the surface of the photosensitive drum 12 at the transfer nip 80. Since a negative voltage of the same polarity as the toner image on the photosensitive drum 12 is applied to the first electrode 74 at this time, a discharged is suppressed between the transfer-receiving member and the photosensitive drum 12 at the area 86 directly anterior to the transfer nip 80. Although a voltage of the same polarity as the toner is applied to the first electrode 74 in the second embodiment, the voltage applied to the first electrode 74 may have the opposite polarity of the toner or may even be a grounded voltage insofar as the voltage is capable of controlling the discharge phenomenon at the area 86 directly anterior to the transfer nip 80.

On the other hand, since a positive voltage is applied to the transfer member 78 by the second electrode 76, a transfer electric field is formed between the transfer-receiving member and the photosensitive drum 12 at the transfer nip 80, such that a toner image formed on the photosensitive drum 12 is transferred onto the transfer-receiving member by means of the electrostatic action of this electric field.

In the image forming apparatus 70 of the second embodiment, since the voltage applied to the first electrode 74 suppresses a discharge between the photosensitive drum 12 and the transfer-receiving member, excellent transfer of a toner image to a thin-sheet transfer member is obtained even when the voltage applied to the second electrode 76 is a voltage sufficient to form an electric field capable of transferring a toner image to a thick-sheet transfer member. That is, excellent transfer of a toner image is obtained for various transfer-receiving members such as thick sheets and thin sheets by applying the same voltage to the second electrode 76.

Figure 9:
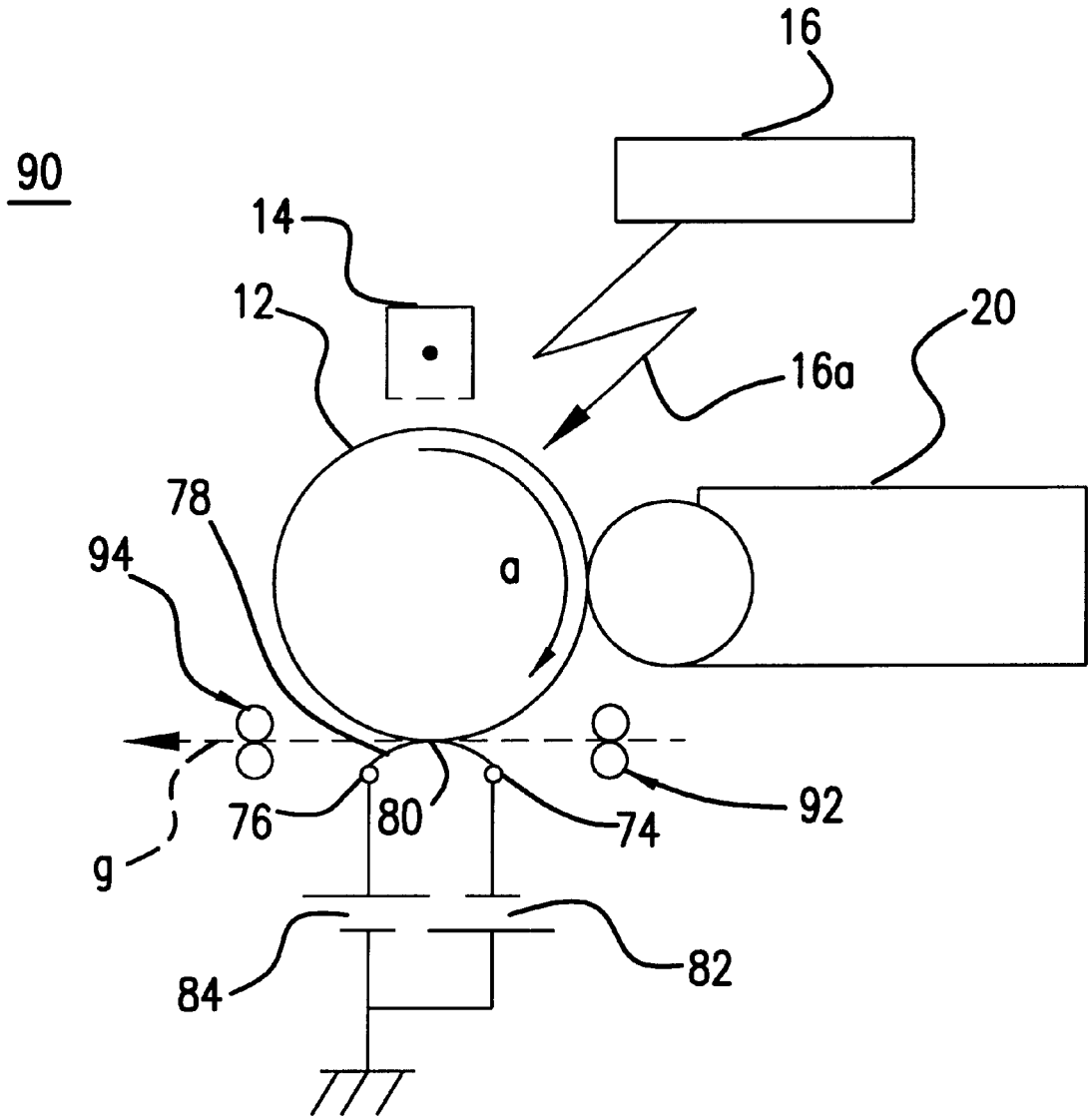
FIG. 9 briefly shows the construction of a modification of the image forming apparatus of the second embodiment.

The image forming apparatus 90 shown in FIG. 9 is a modification of the previously described image forming apparatus 70, and uses a stationary type transfer member 78 and first and second electrodes 74 and 76, and the transport-receiving member is transported by the pairs of transport rollers 92 and 94 disposed on bilateral sides of the transfer nip 80.

This image forming apparatus 90 attains the same effectiveness as the image forming apparatus 70.

A negatively charged toner is used in the image forming apparatuses of the previously described embodiments, but when a positively charged toner is used, a voltage of opposite polarity may be applied to the first and second electrodes and the transfer roller.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A transfer device, comprising:

an image-bearing member supporting a charged developer image;

a movable transfer body transferring a developer image in a transfer region;

a first and a second electrode disposed on the upstream side and the downstream side in the direction of movement of the transfer body relative to the transfer region;

an opposed electrode opposing the second electrode through an intermediate transfer body; and a voltage supplying device applying to the first electrode a first voltage for controlling the discharge between the transfer body and the image-bearing member, and applying between the opposed electrode and the second electrode an electric field for transferring charged developer between the image-bearing member and intermediate transfer body to which a second voltage is applied.

2. The transfer device claimed in claim 1, wherein the first voltage is a voltage of the same polarity as the charge polarity of the developer image, and the second voltage is a voltage of opposite polarity to the charge polarity of the developer image.

3. The transfer device claimed in claim 2, wherein the image-bearing member is a dielectric body and the transfer body is a recording sheet.

4. The transfer device claimed in claim 1, wherein the first voltage has a voltage value located at a position deflected to the same polarity side as the charge polarity of the developer image relative to the second voltage.

5. A transfer device, comprising:

an image-bearing member supporting a charged developer image;

a movable transfer body transferring a developer image in a transfer region, and disposed in contact with the image-bearing member so as to form a predetermined nip width;

a first and second electrode disposed on the upstream side and the downstream side in the direction of movement of the transfer body relative to the transfer region;

an opposed electrode opposing the second electrode through an intermediate transfer body; and a voltage supplying device applying to the first electrode a first voltage for controlling the discharge between the transfer body and the image-bearing member, and applying to the second electrode a second voltage for forming a transfer electric field for transferring charged developer between the intermediate transfer body and the image-bearing member.

6. The transfer device claimed in claim 5, wherein the first voltage is a voltage of the same polarity as the charge polarity of the developer image, and the second voltage is a voltage of opposite polarity to the charge polarity of the developer image.

7. The transfer device claimed in claim 5, wherein the first voltage has a voltage value located at a position deflected to the same polarity side as the charge polarity of the developer image relative to the second voltage.

8. The transfer device claimed in claim 5, wherein the image-bearing member is a photosensitive body and the transfer body is a dielectric body.

* * * * *